US006120569A

United States Patent [19]

Kuo

[11] Patent Number: 6,120,569

[45] Date of Patent: Sep. 19, 2000

[54] METHOD FOR PRODUCTION AND STRUCTURE OF STONE PATTERN PROCESSING MILLS

[76] Inventor: Ching-An Kuo, No. 1, Lane 246, Chou-Mei. St., Taipei, Taiwan

[21] Appl. No.: 09/159,826

[22] Filed: Sep. 23, 1998

[51] Int. Cl.[7] ..... C09K 3/14

[52] U.S. Cl. ..... 51/298; 51/299; 51/293; 51/307; 51/309; 51/303

[58] Field of Search ..... 51/295, 303, 307, 51/309, 298, 299, 293

[56] References Cited

U.S. PATENT DOCUMENTS 5,070,656 12/1991 Brogden ..... 451/353
5,104,421 4/1992 Takizawa et al. ..... 51/303
5,373,666 12/1994 Quintilio ..... 451/241
5,476,410 12/1995 Lupi ..... 451/56
5,863,306 1/1999 Wei et al. ..... 51/309

*Primary Examiner*—Michael Marcheschi
*Attorney, Agent, or Firm*—Pro-Techtor Internationa Services

[57] ABSTRACT

A method for production of stone pattern processing mills including the steps of application of compression to resin, cellulose, and milling material in a mold module. The resin and milling material are combined to form milling granules to be bound to the cellulose substances so as to form a milling grain cellulose layer. The backside of the milling grain cellulose layer is covered with suitable flexible substances to form a hollow-set machine/grind cushion meant for coupling with a mill chassis for use. Alternatively, the backside of the machine/grind cushion may be filled with flexible or hard material so as to form a one-piece mill.

9 Claims, 6 Drawing Sheets

METHOD FOR PRODUCTION AND STRUCTURE OF STONE PATTERN PROCESSING MILLS

BACKGROUND OF THE INVENTION

1. Field of the Invention

This invention relates to a method for production of stone pattern processing mills, more specifically, it relates to one method for production of tooling molds to be employed for stone pattern processing purposes 2. Description of the Prior Art Stones commonly used for industrial purposes such as marble, granite, and so forth, go through cutting, flattening, shaping and grinding procedures in the course of processing. To yield end products, they must go through repeated patterning, trimming, and grinding phases in order to turn the stones into products with required useful and beautiful configurations. The most frequently applied form of processing calls for peripheral, rim and corner grinding. In short, pattern processing is an important and necessary procedure in the course of overall processing of stone materials into useful end products.

Tools and implements usually employed for pattern processing of raw stone materials come in a variety of forms and specifications, with cross sections which can be arcuate, trapezoidal, or cambered. The tools are chosen specifically to meet the specific profile of the pattern to be processed. Processing requirements can include crude grinding, fine grinding and precision grinding. Crude grinding is accomplished using crushed diamonds and similar hard particles as milling elements. The grinding tools are derived by electric casting or other means. Patterns are set by crude grinding pursuant to stone pattern processing technology, such as is disclosed in U.S. Pat. No. 5,476,410, titled 'Methods for Processing of Granites and Marbles', whereby a complete configuration is obtained by repeated crude, fine and precision processing using tools comprising different granules of different characteristics as the milling medium. In the present invention the mills to be used are those specific for pattern processing for which the bonding agents to be employed are resins indicated for application in fine grinding as well as precision grinding purposes.

Conventionally, pattern processing tools for fine grinding and precision grinding of stones are prepared by having belts adhered with milling grains manually and orderly applied onto mill surfaces. The mill is seated on a chassis and comes in a variety of models. A shortcoming of such conventional tooling practice, however, is that with the belt being manually adhered with milling grains, a waste of labor and time is inevitable. Productivity is therefore substantially reduced, which means a rise in production costs.

Another deficiency with the conventional art lies in that with the belts comprising manually adhered milling grains, the end products of the bonding efforts may not be adequate. With mill implements installed onto machines, a mold machining run with manually applied grain milling belts can often result in loosening, and eventually disengagement, of the grain milling belts owing to disproportionate application of force or inappropriate, inadequate adhesion. The pattern processing is therefore affected and creates a nuisance to the user.

Accordingly, given the shortcomings found with the aforementioned prior art, improvement is urgently needed.

SUMMARY OF THE INVENTION

The present invention is primarily aimed at providing a method for the production of a stone pattern processing mill.

Specifically, the present invention calls for the bonding, by heat compression or alternatively cold casting, in a mold substances including: milling grains, a bonding agent (resin) and cellulose, followed by packing and covering with flexible elements to produce a machine/grind cushion. When the cushion is installed in a molding chassis, it is good for grinding processing purposes. A mold prepared in this manner is relieved of the complicated production procedures and operational drawbacks inevitably associated with milling grain adhesion belts. For that reason, the present invention is further endowed with merits such as easy production and lowered production costs.

A further object of the present invention lies in the provision of a method for production of stone pattern processing mills, wherein said machine/grind cushion may be optionally packed with flexible or hard substances. The cushion is duly supported by the mold so that both the cushion and the mill chassis are embodied together facilitating ease of production, and in particular, convenience of mass production at reduced production costs.

A further object of the present invention is to provide a method for production of stone pattern processing mills embodying all the aforementioned milling grains, resin and cellulose to exhibit better anti-wear effects so that incidents such as loosening and disengagement of milling grains are less frequent.

A further object of the invention is to provide a method for production of stone pattern processing mills embodying altogether all the aforementioned milling grains, celluloses bonded in the mill so that the layer of milling grain on taking form, will correspond with mill-specific configuration, and accuracy of milling angle is enhanced in like measure.

A method for production of stone pattern processing molds according to the present invention comprises essentially a production method for a one-piece stone pattern processing mold. Alternatively, the production method may comprise a mold assembled from one machine/grind cushion and one mill chassis.

To begin the process, bonding agents, milling grain and cellulose must be placed into the mill to secure a bonding effect by heat compression or cold casting technique. This produces cellulose containing milling particles. The cellulose is then packed and covered with flexible materials to create a flexible piece that can be easily removed from the mold. The flexible piece is the used to prepare a machine/grind cushion which, once matched to a mill chassis is good for grinding purposes. Alternatively, the aforementioned machine/grind cushion may have a hollow back side filled so that a one-piece grind tool is produced for use. It is also to be noted that the aforementioned method for production of a machine/grind cushion can be modified by having the cellulose back side filled with flexible substances before heat compression to bond both the milling grain and the bonding agent. Or one may fill the milling grain cellulose layer following completion of preparation of the milling grain cellulose layer, so as to produce a one-piece grind tool. This method is preconditioned by a match-and-assembly mold fabrication procedure to absolve unwanted mold removal problems associated with grinding tool products.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1A:
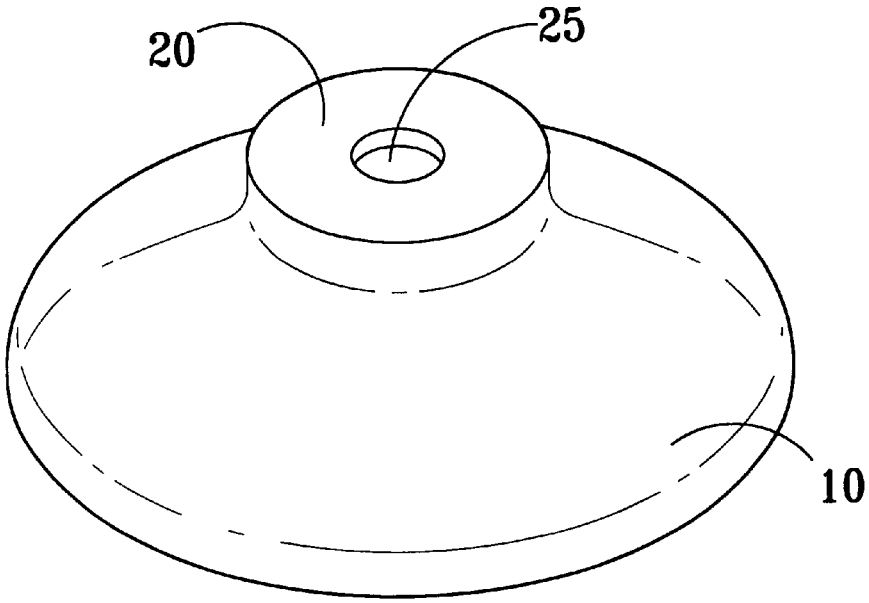
PRIOR ART FIG. 1A
FIG. 1A is a three-dimensional perspective of one as-formed mill chassis meant for stone pattern processing under a prior art.
Figure 1B:
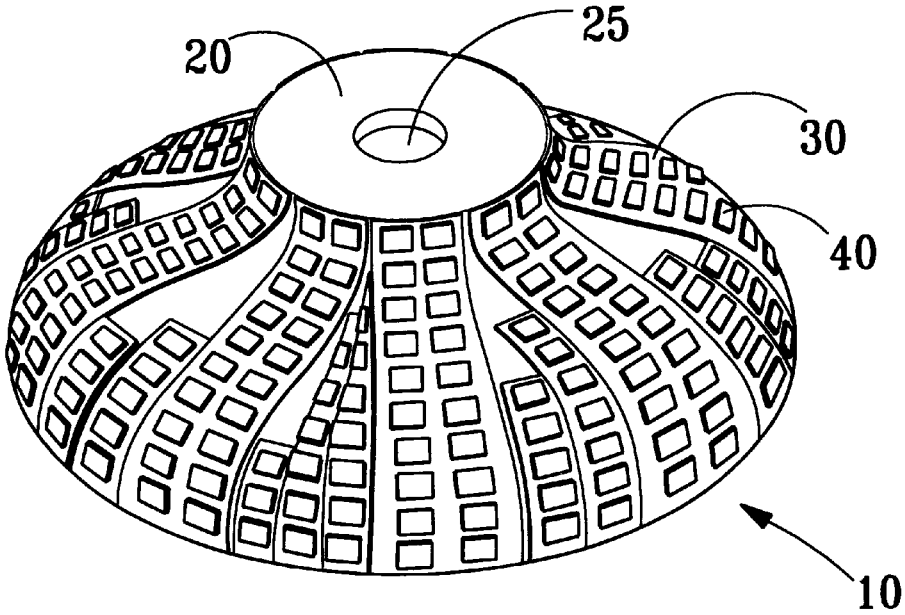
PRIOR ART FIG. 1B
FIG. 1B is a three-dimensional perspective of a shaping mill chassis integral with milling grain belt embodied for a prior art stone pattern processing mill.

Referring now to FIG. 1A, a three-dimensional perspective of a prior art mill chassis structured for stone pattern processing, it will be appreciated that under the prior art, a mill chassis 10 is fabricated by taking into account the configuration of objects meant to be processed therewith. Milling materials are made available outside the chassis 10 for application. There is a shaft 20 section together with a round hole 25 forming the central part of the chassis 10. The round hole 25 is meant to accommodate setting of the mill chassis 10 integral with the body. Referring to FIG. 1B, a three-dimensional perspective of a shaping mill chassis integral with milling grain belt embodied for a prior art stone pattern processing mill, it will be appreciated that under the prior art, fabrication of a mill is based on a chassis 10, on the surface of which are disposed by adhesion a number of milling grain belts 30 dotted with milling grains 40. When the mill is to be installed onto the body, pattern processing is run by rotative machining, whereupon milling grains 40 on the belt 30 come into contact with the object stone and pattern processing operates with the friction derived. With such prior art methods, a number of problems exist. First, problems arise in the course of adhesion of the milling grain belts 30. The surface of the mill chassis 10 will yield curvature in response to profiling requirements, with milling grains 40 being applied by adhesion to the belts 30. These belts 30, when attached to the surfaces of the milling chassis 10, may be difficult to adhere tightly to the curved surfaces of the milling chassis 10. That results inevitably in the occurrence of error of the grinding/milling angle, which consequently affects the apparent profile and angle of the processed stone. Also, since the milling grain belts 30 are prefabricated, they will rarely form a perfect coating overlying the surfaces of the mill chassis 10. Shear produced on contact between the milling grains 40 and the object stone being processed will much too often result in loosening or withdrawal of both the milling grain belts 30 and the milling grain 40.

Figure 2A:
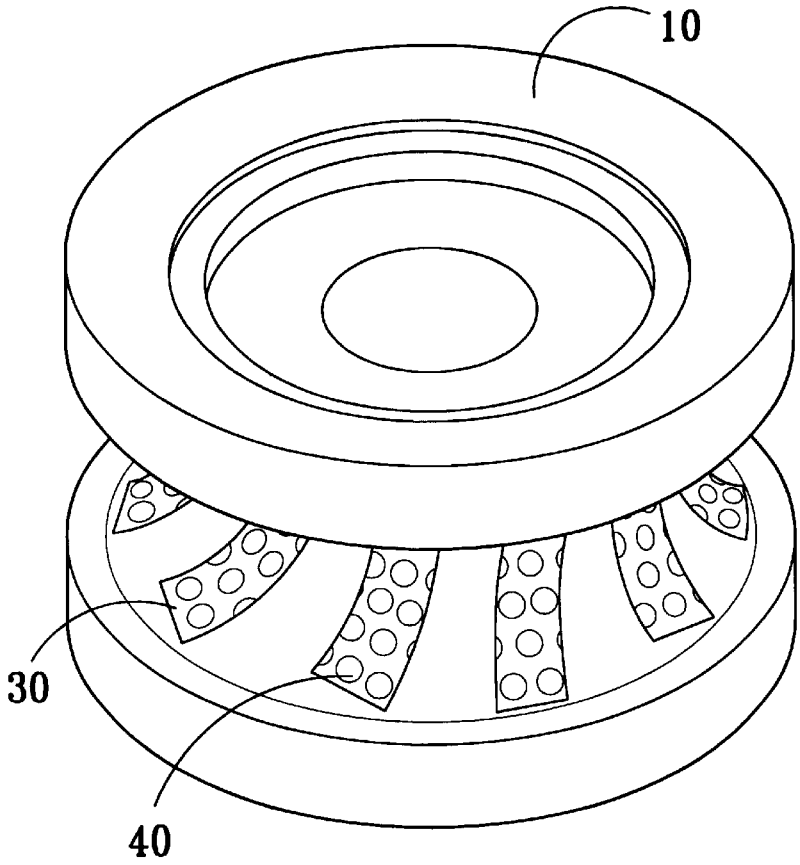
PRIOR ART FIG. 2A
FIG. 2A is a three-dimensional perspective of a prior art stone pattern processing mill.
Figure 2B:
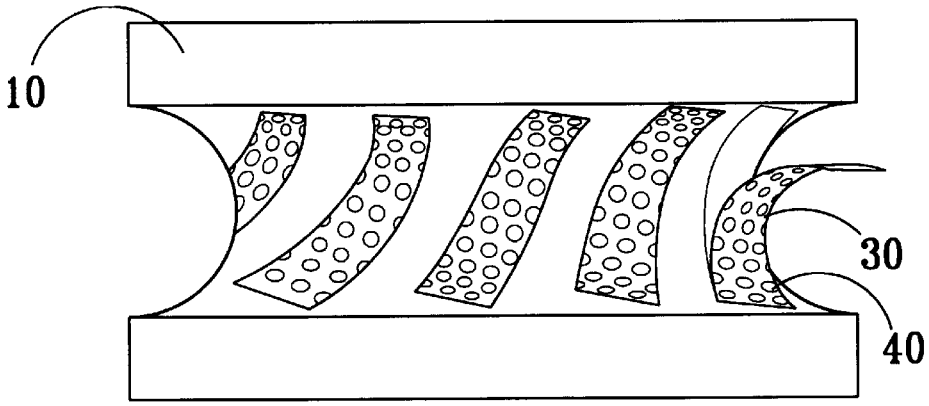
PRIOR ART FIG. 2B
FIG. 2B is an elevation view of a prior art stone pattern processing mill.

Referring now to both FIG. 2A and FIG. 2B, respectively a three-dimensional perspective and an elevation view of a prior art stone pattern processing mill, it can be readily appreciated that with respect to different mill chassis models 10, disposition of milling grains 40 is mostly by means of the aforementioned belt 30 adhesion method. There are three problem areas associated with this method of processing mill production: (1) the adhesive strength between milling grains 40 and milling grain belts 30; (2) the adhesive strength between the milling grain belts 30 and the mill chassis 10; and (3) workmanship and patience on the part of the worker in charge of manual adhesion of the milling grain belts 30.

Figure 3B:
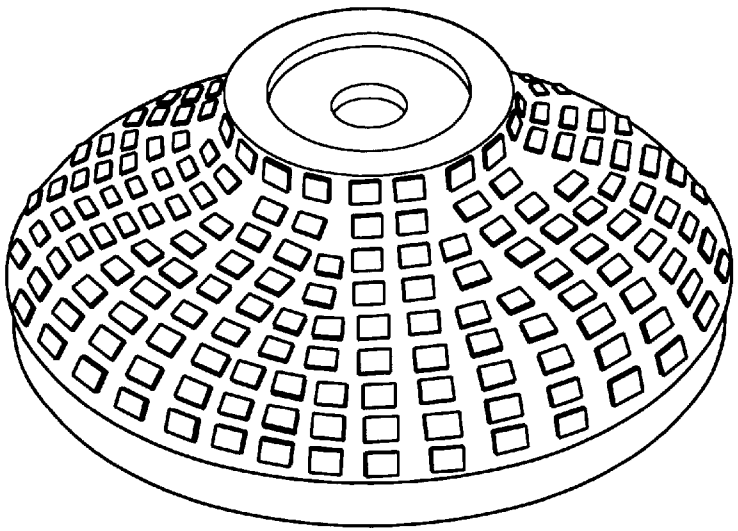
FIG. 3B is an illustration of the present invention as executed in a first embodiment assembled to form.
Figure 3A:
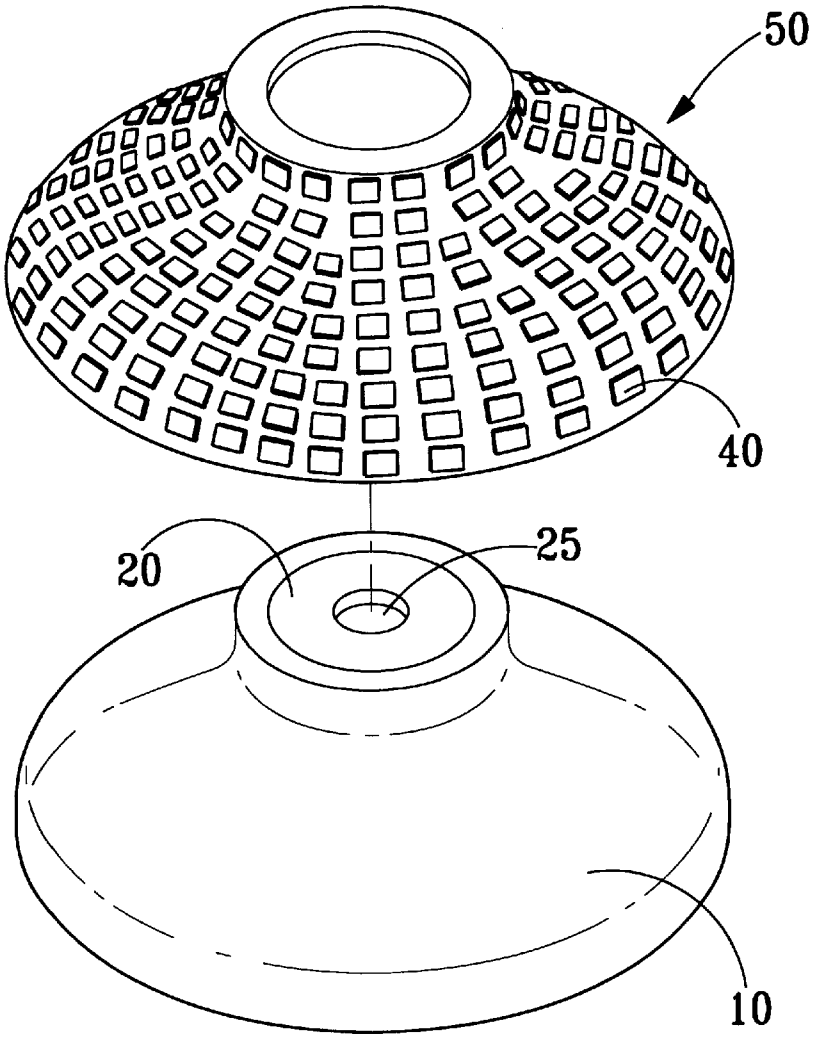
FIG. 3A is an exploded view of the present invention, a method for production of a stone pattern processing mill as executed in a first embodiment.
Figure 4:
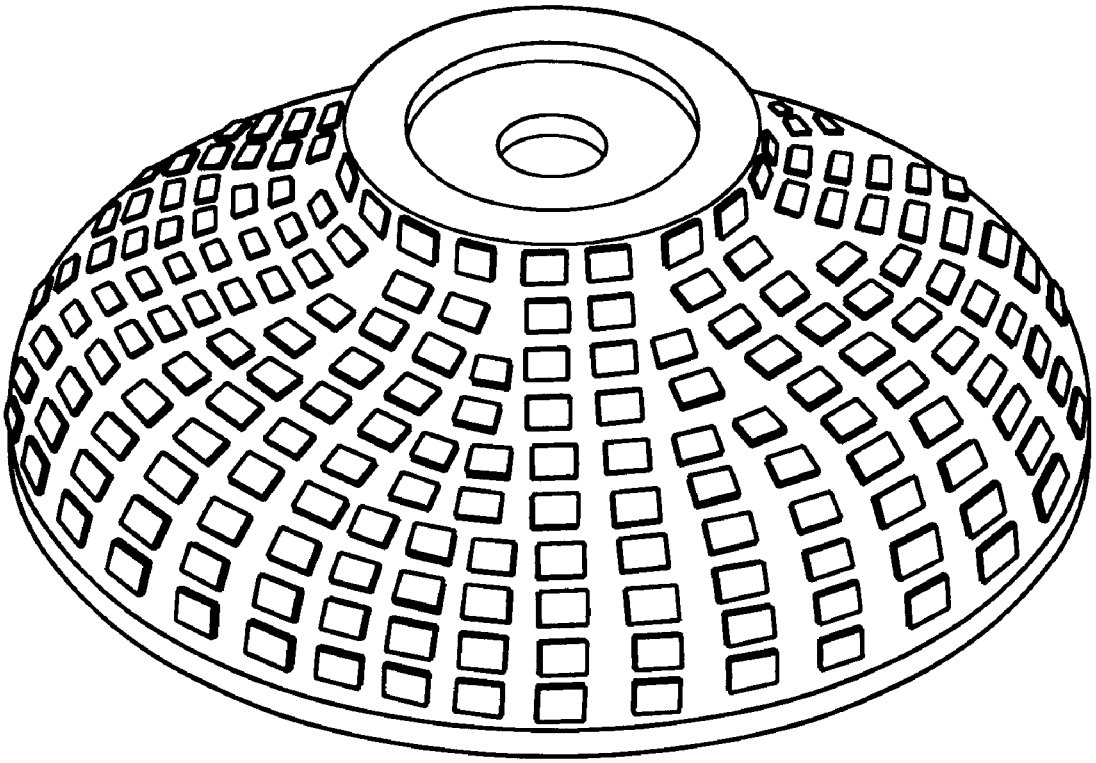
FIG. 4 is an illustration of the present invention as executed in a second embodiment.

Referring now to FIG. 3 and FIG. 4 representing respectively the present invention method for production of stone pattern processing mills, the idea lies essentially in the introduction of a simplified mill production procedure comprising a machine/grind cushion 50 (FIG. 3A, FIG. 3B), or alternatively a one-piece structure (FIG. 4) to resolve the problems associated with the prior art.

Figure 5:
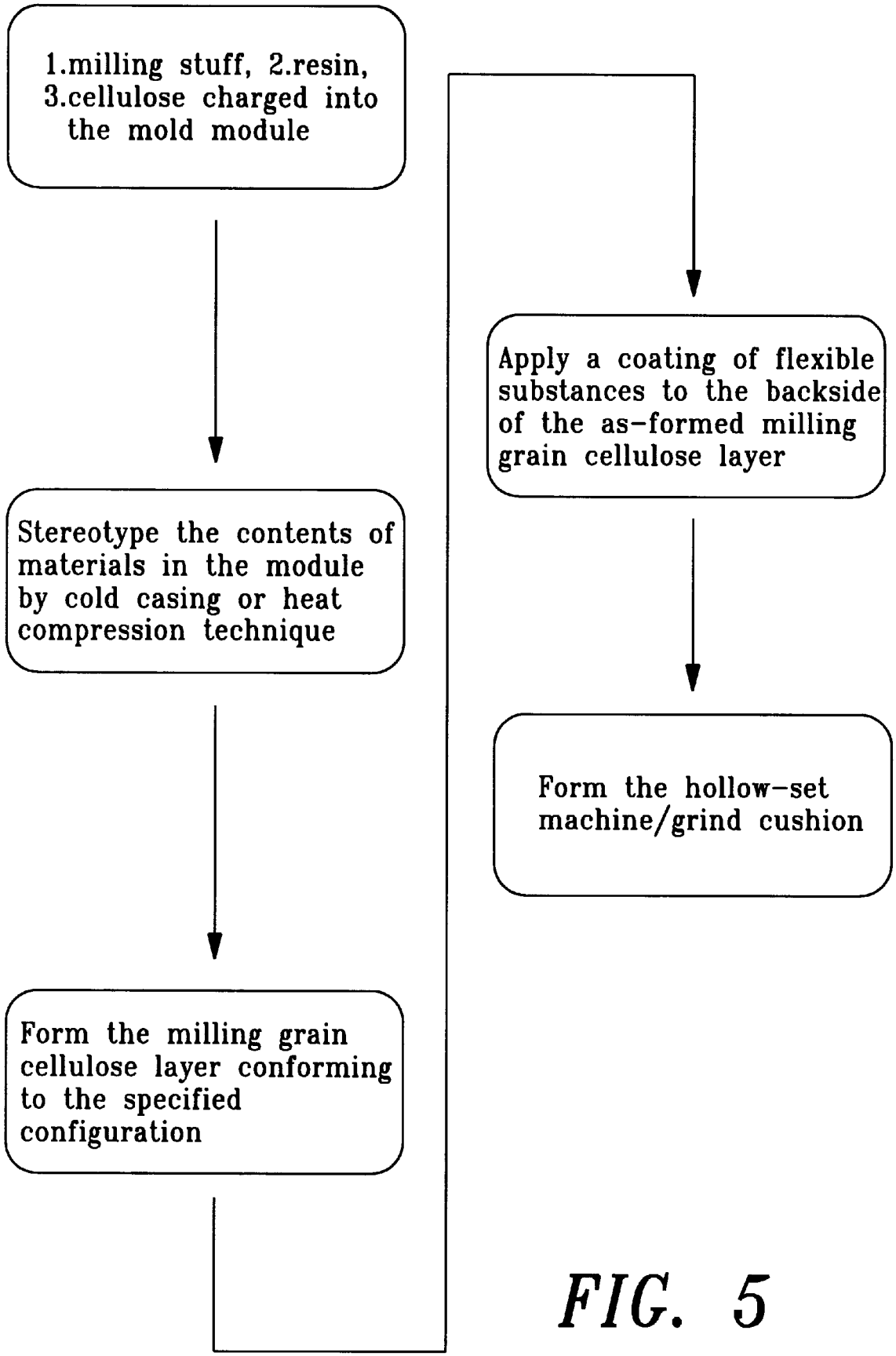
FIG. 5 is a block diagram describing the sequences implemented for a first embodiment of the present invention.

What follows is a description of the invention in two different embodiments:

Method I: (in reference to FIG. 5)

(1) charge first milling material, a bonding agent and cellulose into the as-formed mill module;

(2) using cold casting or heat compression, set the raw material as loaded in the module while remove redundant material;

(3) bring into formation a milling grain cellulose layer as required for the application;

(4) apply one layer of flexible material over the backside of the as-formed milling grain cellulose layer, so as to fortify the structural texture of the milling grain cellulose layer;

(5) form a hollow-set machine/grain cushion.

Said hollow-set machine/grind cushion 50 may be coupled to the mill chassis 10, and secured by adhesives.

As the hollow-set machine/grind cushion 50 is itself flexibly structured, when it is to be removed from the module, there is no milling-grain-to-module-wall sticking, and unwanted loosening of the milling grain 40 is prevented.

Different machining effects are to be expected with different bonding agents intermingled with different milling materials.

In step 4, we apply one layer of flexible material over the backside of the as-formed milling grain cellulose layer, so as to enhance the structural texture of the milling grain cellulose layer. The concern being to facilitate disengagement of the machine/grind cushion 50 from the mold once formed.

In step 1, milling material, a bonding agent and cellulose are loaded together into a module mold, and set by either cold casting or heat compression, as appropriate.

One more thing to note in the aforementioned method of production of a machine/grind cushion is that the procedure of heat compression to be applied onto milling material and bonding agents may be preceded by the filling of flexible substances on the backside of the cellulose layer.

Figure 6:
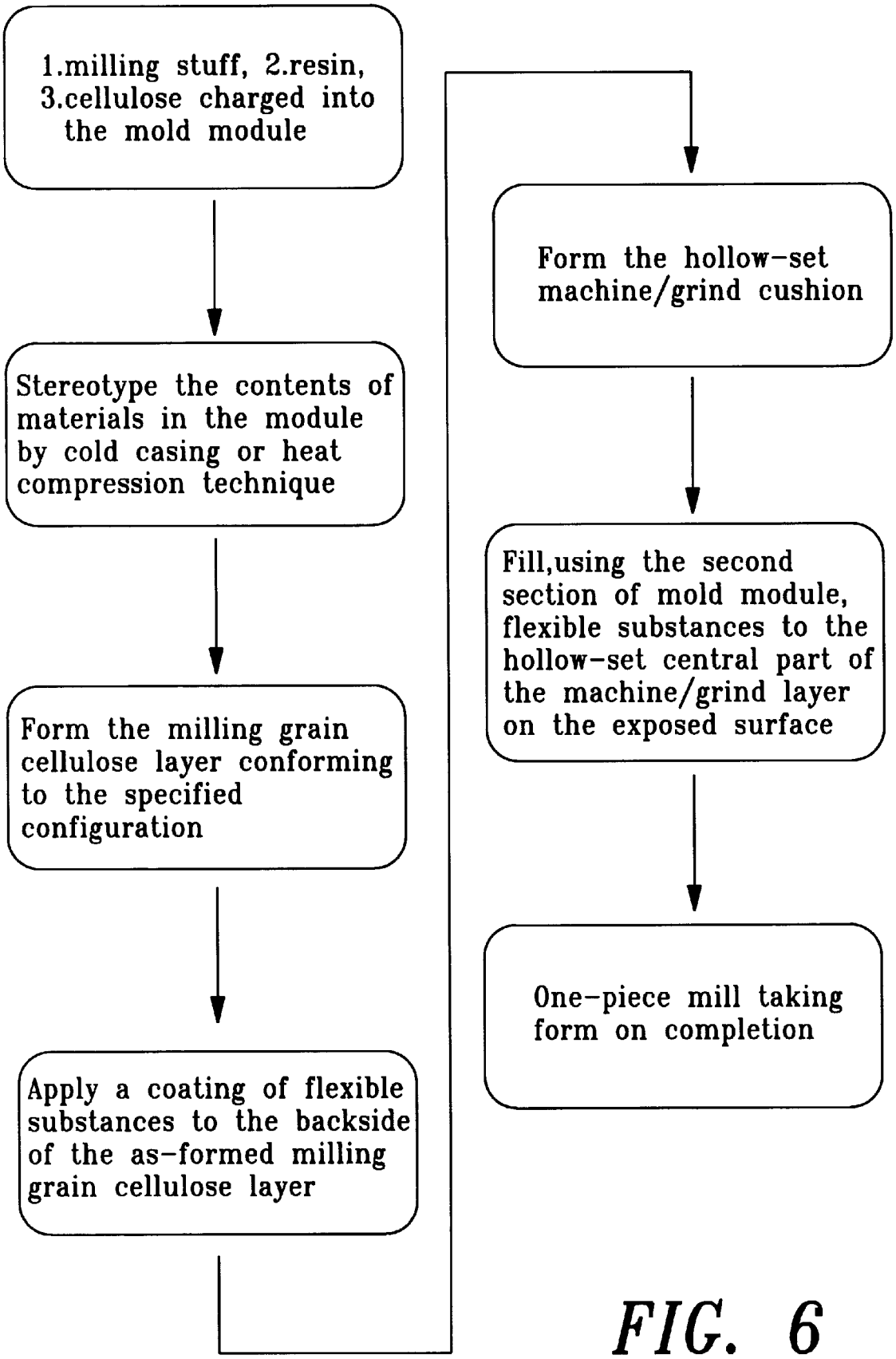
FIG. 6 is a block diagram describing the sequences implemented for a second embodiment of the invention method for production of a stone pattern processing mill.

Method II (in reference to FIG. 6)

(1) as a first step, charge milling material, a bonding agent and cellulose together into the as-formed module;

(2) set the materials thus loaded in the module by cold casting or heat compression while removing the excess stock;

(3) form a milling grain cellulose layer as required;

(4) apply one coating of flexible material over the backside of the as-formed milling grain cellulose layer, so as to reinforce the structural texture of the milling grain cellulose layer;

(5) form a hollow-set machine/grind cushion;

(6) engage the as-formed machine/grind cushion into the second part module (plasticized mold), fill the flexible or hard material into the hollow part of the machine/grind cushion;

(7) form a one-piece mill.

The one-piece mill thus produced may be installed straight onto an implementing body to perform stone pattern grinding operations.

The hollow-set machine/grind cushion 50, being flexible itself, will lose no adhesion between the milling grain and the module wall when it is withdrawn from the module, so loosening of the milling grain is prevented.

Different bonding agents mixed with different milling materials can bring about different machine/grinding outcomes.

In step 1, milling material, a bonding agent and cellulose are loaded together into a module mold, and take form by means of either cold casting or heat compression as appropriate.

One point to note is that in prosecuting step 4, flexible or hard material may be filled directly into the hollow central part of the backside of the milling grain cellulose layer having taken its shape as intended on completion of step 3, 50 as to produce a one-piece mill by bypassing the procedure of making a machine/grind cushion. This methodology calls for coordinated production of a module assembly with a view to deal with the problem of unwanted withdrawal of mill products.

Other advantages of the present invention by comparison to the aforementioned prior art include:

1. In prosecution of the invention method, the pattern processing mill can be produced either integrally in one-piece form or else produced separately in several parts, which means simplified production procedures easier for mass production and for use;
2. By application of the invention method or structure both mill and the milling grain can be united more closely to get rid of the nuisance of loosening of milling grain belts realized when using prior art mills;
3. Substantial savings of both labor and costs in production of the invention mill as compared to prior art models;
4. The possibility of better mill configuration and acquisition of more accurate grinding, machining, milling angle required for pattern consummation.

Many changes and modifications in the above described embodiment of the invention can, of course, be carried out without departing from the scope thereof. Accordingly, to promote progress in science and the useful arts, the invention is disclosed and is intended to be limited only by the scope of the appended claims.

What is claimed is:

1. A method of production of stone pattern processing mills comprising:

(1) charging milling grain, a bonding agent and cellulose together into a mold module;

(2) subjecting the contents of the module to cold casting or heat compression to form a milling grain cellulose layer;

(3) applying one layer of a flexible material to the back-side of the as-formed milling grain cellulose layer so as to enhance the structural texture of said milling grain cellulose layer, thus forming a hollow-set machine/grind cushion; and (4) removing said mold module; wherein said hollow-set machine/grind cushion is engaged by coupling it into a mill chassis.

2. The method according to claim 1, wherein the configuration of the mold module under step (1) is determined by the cross-section of the stone to be processed.

3. The method according to claim 1, wherein said flexible material comprises rubber or synthetic resin.

4. The method according to claim 1, wherein prior to heat compression the backside of the cellulose layer is filled with a flexible material.

5. A method for production of a stone pattern processing mill, comprising:

(1) charging milling grain, a bonding agent and cellulose together into a mold module;

(2) subjecting the mold module to either cold casting or heat compression to form a milling grain cellulose layer;

(3) applying one layer of a flexible material to the backside of the as-formed milling grain cellulose layer so as to enhance the structural texture of said milling grain cellulose layer thus forming a hollow-set machine/grind cushion;

(4) filling the hollow-set central part of the machine/grind cushion with a flexible material, thus forming a one-piece mill; and (5) removing said mold module.

6. The method according to claim 5, wherein the configuration of the mold module under step (1) is determined by the cross-section of the stone to be processed.

7. The method according to claim 5, wherein said flexible material comprises rubber or synthetic resin.

8. The method according to claim 5, wherein prior to heat compression the backside of the cellulose layer is filled with a flexible material.

9. The method according to claim 5, wherein a backside of the milling grain cellulose layer is packed directly with the flexible material following the cold casting or heat compression, so as to form a one-piece mill.

* * * * *